US007807026B2

(12) United States Patent
Tettamanti et al.

(10) Patent No.: US 7,807,026 B2
(45) Date of Patent: Oct. 5, 2010

(54) DISCRETE ANODE FOR CATHODIC PROTECTION OF REINFORCED CONCRETE

(75) Inventors: Michele Tettamanti, Villaguardia (IT); Corrado Mojana, Valmadrera (IT); Giorgio Pedrinelli, Peschiera Borromeo (IT)

(73) Assignee: Industrie De Nora SpA, Milan (IT)

( * ) Notice: Subject to any disclaimer, the term of this patent is extended or adjusted under 35 U.S.C. 154(b) by 259 days.

(21) Appl. No.: 12/051,442

(22) Filed: Mar. 19, 2008

(65) Prior Publication Data

US 2008/0156660 A1 Jul. 3, 2008

Related U.S. Application Data

(63) Continuation of application No. PCT/EP2006/009097, filed on Sep. 19, 2006.

(30) Foreign Application Priority Data

Sep. 20, 2005 (IT) ..... MI2005A1738

(51) Int. Cl.

| | |
|---|---|
| ***C23F 13/08*** | (2006.01) |
| ***C23F 13/10*** | (2006.01) |
| ***C23F 13/12*** | (2006.01) |
| ***C23F 13/16*** | (2006.01) |
| ***C23F 13/18*** | (2006.01) |

(52) U.S. Cl. ..... 204/196.3; 204/196.33; 204/196.37; 205/734

(58) Field of Classification Search ..... 205/734; 204/196.17, 196.18, 196.2, 196.3, 196.33, 204/196.37

See application file for complete search history.

(56) References Cited

U.S. PATENT DOCUMENTS

| | | | | |
|---|---|---|---|---|
| 3,279,043 | A * | 10/1966 | Wirt | 29/896.6 |
| 3,376,684 | A * | 4/1968 | Cole et al. | 52/635 |
| 4,900,410 | A * | 2/1990 | Bennett et al. | 205/734 |
| 5,031,290 | A * | 7/1991 | Brereton et al. | 29/6.1 |
| 5,423,961 | A * | 6/1995 | Bennett et al. | 204/196.3 |
| 6,254,743 | B1 * | 7/2001 | Bennett et al. | 204/284 |
| 2006/0263667 | A1 * | 11/2006 | Toro | 429/38 |
| 2008/0053823 | A1 * | 3/2008 | Mojana et al. | 204/290.01 |

FOREIGN PATENT DOCUMENTS

| | | |
|---|---|---|
| WO | WO 92/01824 A1 | 2/1992 |

* cited by examiner

*Primary Examiner*—Bruce F Bell
(74) *Attorney, Agent, or Firm*—Eschweiler & Associates, LLC

(57) ABSTRACT

There is disclosed a cathodic protection system of reinforced concrete structures with discrete anodes obtained starting from a corrugated planar substrate welded to a longitudinal current collector. The anodes of the invention are particularly suitable for being installed rolled in cylinders, with their axis parallel to the current collectors, positioned inside holes made in the concrete of the structure to be protected.

19 Claims, 3 Drawing Sheets

DISCRETE ANODE FOR CATHODIC PROTECTION OF REINFORCED CONCRETE

CROSS-REFERENCE TO RELATED APPLICATION

This application is a continuation of PCT/EP2006/009097, filed Sep. 19, 2006, that claims the benefit of the priority date of Italian Patent Application No. MI2005A001738, filed on Sep. 20, 2005, the contents of which are herein incorporated by reference in their entirety.

FIELD

The invention relates to the field of cathodic protection of reinforced concrete structures, and in particular to a design of discrete anode for cathodic protection suitable for being installed inside holes or slits made in the concrete.

BACKGROUND

Corrosion phenomena concerning reinforced concrete structures is known in the art. The steel reinforcement inserted in the concrete structures to improve their mechanical properties normally works in a passivation regime induced by the alkaline environment of the concrete. Nevertheless, after a certain time the ion migration across the concrete porous structure provokes a localised attack to the protective passivation film. Particularly worrying is the attack by chlorides, which are virtually present in all kinds of environments where the reinforced concrete structures are employed, and to an even higher extent where an exposure to brackish water (bridges, pillars, buildings located in marine zones), antifreeze salts (bridges and road structures in cold regions) or even seawater, for example, in the case of piers and docks, takes place. The critical value of chloride exposure has been estimated around 0.6 kg per cubic meter of concrete, beyond which the passivation state of the reinforcing steel is not guaranteed.

Another form of concrete decay is represented by the phenomenon of carbonatation, that is the formation of calcium carbonate by reaction of the lime of the cementitious mixture with atmospheric carbon dioxide. Calcium carbonate lowers the concrete alkali content (from pH 13.5 to pH 9) bringing iron to an unprotected state. The presence of chlorides and the simultaneous carbonatation represent the worst of conditions for the preservation of the reinforcing bar of the structures. The corrosion products of steel are more voluminous than steel itself, and the mechanical stress arising from their formation may lead to concrete delamination and fracturing phenomena, which translate into huge damages from the point of view of economics besides that of safety.

It is known in the art that the most effective method for indefinitely prolonging the lifetime of reinforced concrete structures exposed to the atmospheric agents, even in the case of remarkable salt concentrations, consists of cathodically polarising the steel reinforcement. In this way, the latter becomes the site of an oxygen cathodic reduction, suppressing the anodic corrosion and dissolution reactions. Such a system, known as cathodic protection of reinforced concrete, is practised by coupling anodic structures of various kinds to the concrete, with the reinforcement to be protected acting as a cathodic counterelectrode. The electrical currents involved supported by an external rectifier travel across the electrolyte, a porous concrete partially soaked with a salty solution. The installation of a cathodic protection system may be carried out since the beginning, on newly constructed structures (in such case, reference is often made to a "cathodic prevention system") or as a retrofitting of older structures.

The anodes commonly used for the cathodic protection of reinforced concrete consist of a titanium substrate coated with transition metal oxides or other types of catalysts for anodic oxygen evolution. As the substrate it is possible to make use of other valve metals, either pure or alloyed. Pure titanium is, however, the largely preferred choice for the sake of cost. From the system design standpoint, the cathodic protection of a reinforcing frame may be carried out according to two distinct ways, that is with distributed or with discrete anodes. The protecting structure with distributed anodes provides covering the concrete cover surface of the reinforcement to be protected, suitably prepared, with anodes consisting of highly expanded meshes; the anodes are then covered with a few centimeter thick fresh cement layer. Alternatively, mesh or solid ribbons can be installed in conduits cut within the cover (whose depth is not sufficient to reach the iron), then filling said conduits with cement mortar. In newly constructed structures the anodes, typically anode mesh ribbons, can be installed directly over the reinforcing cage, kept electrically insulated from the iron by means of plastic or concrete-like spacers.

The anodic system is embedded in the structure at the time of casting the concrete for the construction. A slight direct current (typically from 1 to 30 mA per $m^2$ of reinforcement) applied to the anodes, distributed along the whole structure, imposes a uniform cathodic potential to the reinforcement to be protected in case the latter has a sufficiently simple and regular shape. Conversely, if the reinforcement has a complex shape and presents some portions which are less accessible than others, or which have a different steel density per unit surface or other kinds of irregularities, it may be troublesome to ensure a sufficient protection to all of the reinforcement portions without providing an excess of current to other portions.

The discrete anode-type protection structure permits to overcome this inconvenience by using separate anodes, for instance in form of bars, plates, rods or segments of mesh or ribbon, installed in suitable holes or slits obtained in the concrete and cemented therein with cement mortar after their placement. The discrete anodes may be placed according to the needs, increasing their number or decreasing their spacing in those spots where it is necessary to provide more current. For some structures, a combination of mesh and ribbon anodes and of discrete anodes can be provided in order to obtain the best protecting effect. The maximum current density applicable to the above described type of anodes (mesh, ribbons or discrete anodes) is limited by the need of preventing an excessive concrete acidification in the surrounding zone. The latter in fact causes damages of several kinds, among which the build up of reaction products in a limited region around the anode and the consequent mechanical action which deteriorates the surrounding mortar with an inevitable steep rise in the interface resistance. The regulations in force provide a maximum current density per anode effective active surface (that is surface referred to the sum of the two faces) of 110 $mA/m^2$ at most. Hence, to be able to supply the required protection current in compliance with the maximum current density, it is advisable to maximise the anodic surface per unit length without increasing too much the cost of materials as well as the installation cost associated with the manufacturing of deep holes or cuts in the concrete. Under another aspect, in order to restrict the installation costs it is also necessary to improve the ease of transportation and assembly of the anodes as much as possible. Finally, it is necessary to identify electrode geometries capable of increasing as much as possible the adhesion of the anode to the cement mortar used for their fixing. The electrode geometries of prior art discrete anodes evidence important deficiencies under all of these aspects, for instance because the anode surface increase per unit length may only be achieved by an increase in the diameter or length thereof. Moreover, the installation of cylindrical or of mesh or solid ribbon-shaped anodes may prove very difficult in vertical surfaces or on structure ceilings, where such anodes must be suitably anchored to the holes or slits obtained in the concrete before being covered with fresh mortar, to prevent them from falling under the action of gravity.

BRIEF DESCRIPTION OF THE DRAWING FIGURES

For the sake of a better understanding of the invention reference will be made to the following drawings, having the purpose of illustrating some preferred embodiments thereof without constituting any limitation whatsoever.

DETAILED DESCRIPTION

Figure 1:
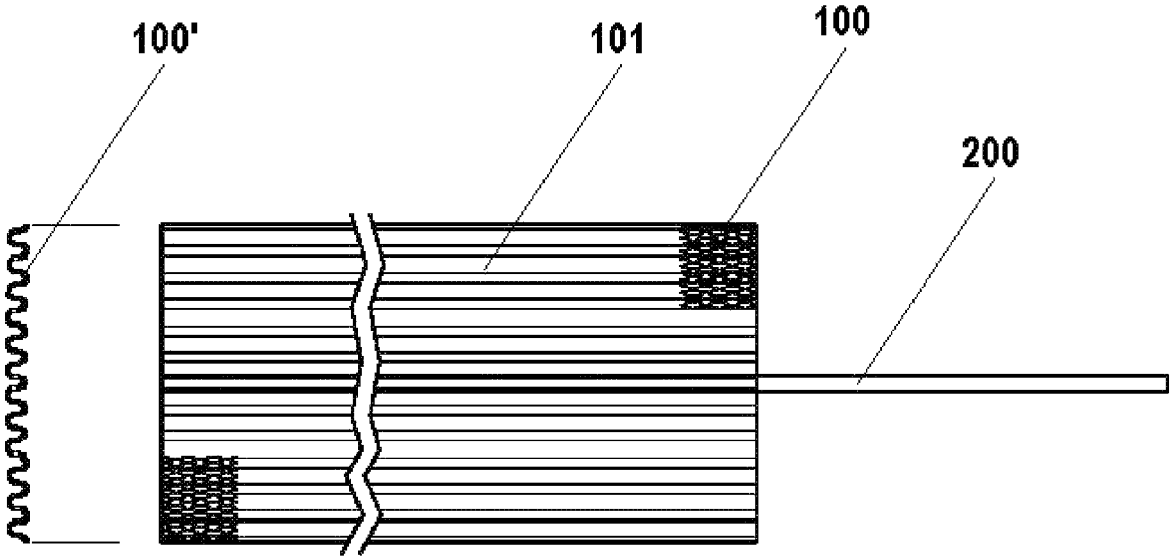
FIG. 1 illustrates a plan view and a cross-section of a first embodiment of the anode of the invention.

The anode of the invention comprises a corrugated titanium or other valve metal planar substrate, welded to a current collector and provided with a superficial catalytic activation, suitable for being rolled on itself in order to form a cylinder.

As used herein, the term "cylinder" is defined as generally encompassing surfaces approximating a cylindrical shape, in particular disregarding the deviation introduced by the corrugations.

The corrugated substrate comprises a thin undulated mesh, and the current collector comprises, for example, a rod or strip, for instance welded to the center or along one side of the activated substrate.

The term corrugated substrate, as used herein, generally refers to a substrate having a profile formed into folds or furrows of any shape suitable to define a grooved surface, including folds with a continuous bend and pleats with sharp corners, optionally in combination with flattened ends.

The substrate can be thin enough to be easily subjected to the cylindrical folding, which is carried out parallel to the main dimension of the current collector. The substrate thickness can, on the other hand, be sufficient to maintain a permanent superficial corrugation, and to impart an elastic behaviour to the cylindrically folded anode. In one embodiment, the substrate comprises an undulated mesh of initial thickness between 0.2 and 2 mm, with a length between 30 and 300 mm, and with a number of grooves per linear meter between 20 and 2000. The final thickness after the corrugation process which defines the grooved geometry comprises between 1 and 30 mm.

The cathodic protection system comprises a multiplicity of anodes of the invention folded into cylinders, forcedly inserted in suitable cylindrical holes or openings made in suitable zones of the concrete surrounding the metallic reinforcement to be protected and fixed with cement mortar. In one embodiment, the anodes of the cathodic protection system may be further provided with an external insulating ring or other equivalent means to prevent short-circuiting with the surrounding exposed rebar, as is known to those skilled in the art. In an alternative or additional embodiment, the anode may be pre-filled with cement mortar or other porous electrically insulating material before its insertion in the appropriate hole.

According to a further embodiment, the anode may be pre-welded in a cylinder before installation in the concrete. This configuration is suitable when the drilling of the relevant hole is liable to cut across the reinforcing bars and the installation of an anode in the form of an open cylinder could cause a short circuit between the anode cylinders and the reinforcing bar exposed by the drilling procedure. A pre-welded cylindrical anode may be suitably used when cathodic prevention is applied during construction of a concrete structure. Such preformed cylinders may be installed on the rebar cages suitably distanced by an insulating spacer. In particular, the anode cylinder may be precisely positioned near the high steel density areas of the rebar cage in order to assure an optimum localised current distribution.

In one embodiment, the anode may be installed without a cylindrical folding, for example, in a flat or intermediate bent open position (e.g. folded in a semicircle or crescent and the like), in suitable slits made in the concrete. The advantages of this type of construction will be apparent to one skilled in the art. The corrugated substrate presents a much larger active surface than the projected surface (for instance, 1.5 times as much or more), so that the total current which can be supplied in compliance with the regulations per unit length is increased by a significant factor, for example, by 50% or more.

The anodes are easy to activate and transport, since they can be catalyst-coated and handled as planar sheets, and effortlessly folded into cylinders at the time of their use. The current collector may be fixed before or after transportation, as necessary. The anode, manually folded and optionally kept in a cylindrical shape by application of clips, is forced into the holes made in the concrete, optionally by aid of a guide tube of plastic material subsequently extracted from the site. The elastic behaviour of the anode contributes to a good fixing to the walls of such holes. The anchoring of the cement mortar, subsequently cast or sprayed into the holes at the moment of fixing and optionally also applied to the anodes prior to their insertion in the holes, is favoured by the anode corrugated surface.

Referring to FIG. 1, there is illustrated a plan view of an embodiment of the anode of the invention manufactured on a planar substrate comprising an undulated mesh 100. For the sake of clarity of the drawing, the undulated mesh corrugation is identified as 101 in a schematic fashion, without reproducing the surface design thereof. The cross section of the same undulated mesh is indicated by 100'. It will be understood that the undulated mesh 100 is just one of the possible corrugated substrates suitable to practice the invention, but many other geometries can be fit to the scope including one or more of, for example, solid, perforated or expanded sheets, metal foams and the various combinations obtainable by juxtaposing solid or preferably foraminous elements of such kind. Factors to be considered in the choice of a particular corrugated substrate geometry are given by the ease of folding into cylinders, by the elastic behaviour, and by the ease of obtaining and maintaining a permanent corrugation.

The anodic substrate 100 is activated by means of a catalytic coating known to those skilled in the art, containing catalysts for oxygen evolution reaction, for example, mixtures of noble metals such as iridium, platinum, palladium, ruthenium, oxides thereof and/or oxides of other transition metals such as titanium, tantalum, niobium, zirconium, molybdenum, cobalt and the like. In the embodiment of FIG. 1, a current collector 200 is welded to the corrugated substrate 100 in a central position. The current collector 200 comprises, in one embodiment, a rod. In another embodiment the current collector 200 may comprise a bar or strap or other longitudinal current collector known in the art.

Figure 2:
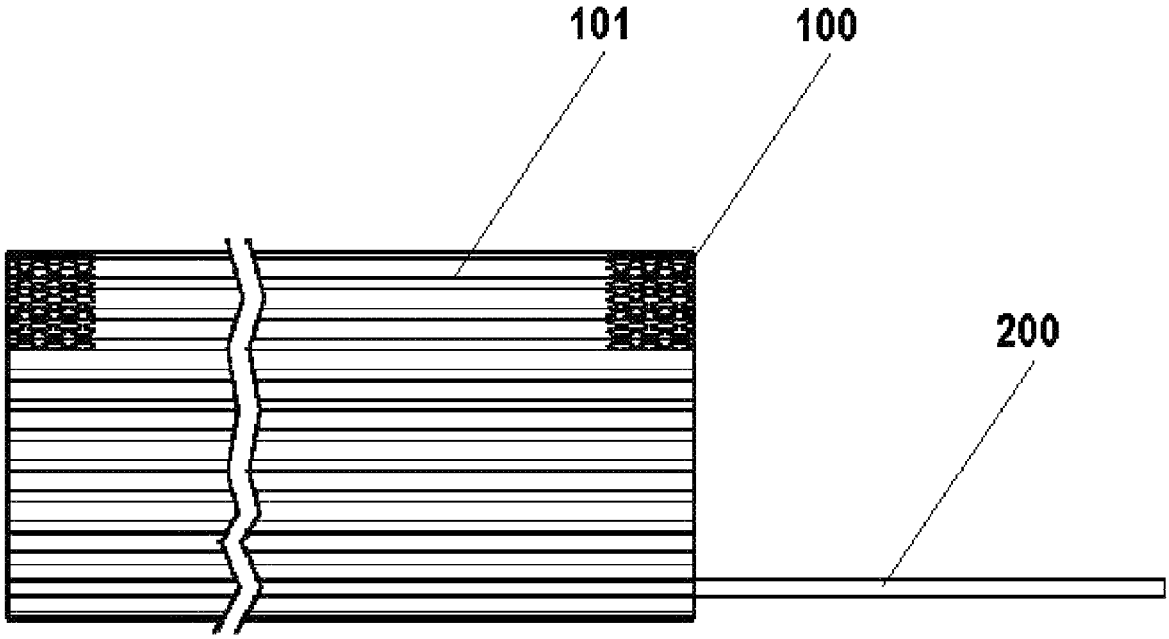
FIG. 2 illustrates a plan view of a second embodiment of the anode of the invention.

FIG. 2 illustrates a plan view of an embodiment of the anode of the invention equivalent to that of FIG. 1, except that the current collector 200 is welded in a lateral position with respect to the planar substrate 100. In both cases, the invention provides the planar substrate be folded by joining the two parallel edges to the current collector 200 so as to form a cylinder at the time of installation.

Figure 3:
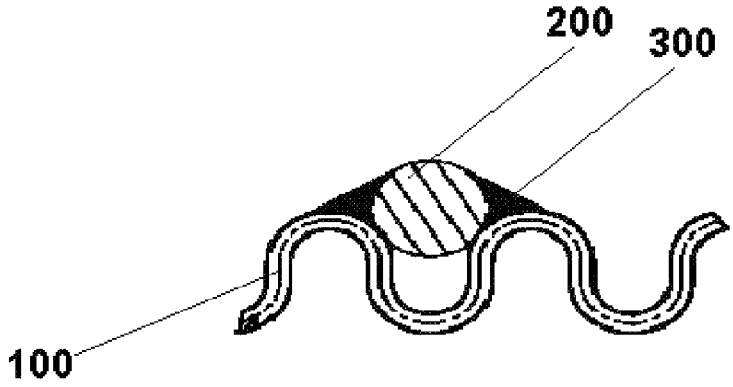
FIG. 3 illustrates a detail of the fixing of the undulated substrate of the anode of FIG. 1 to the current collector.

In FIG. 3 there is illustrated a detail of the fixing of the undulated mesh acting as the anodic substrate 100 to the current collecting rod 200 by means of a weld 300 executed in accordance with one of the techniques known in the art.

Figure 4:
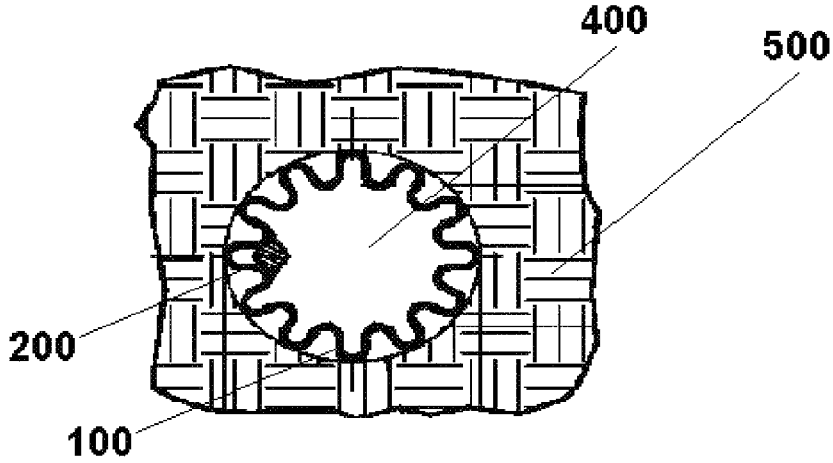
FIG. 4 illustrates a top-view of the discrete anode of the invention installed in the relevant cathodic protection system of reinforced concrete structures.

FIG. 4 illustrates a top-view of the discrete anode of the invention installed in a cathodic protection system for reinforced concrete structures. The corrugated substrate 100 is rolled in a cylinder with axis parallel to the current collector 200 and the anode is forcedly inserted into a hole 400 obtained in the concrete 500. After installation, the anode is fixed by a cement mortar application (not shown). A multiplicity of anodes installed according to an equivalent embodiment, distributed in accordance with the protection requirements of the steel reinforcement and anodically polarised, constitutes the cathodic protection system of the discrete anode-type of the invention. The corrugated substrate 100, as displayed in FIG. 4, has a profile with continuous bends. However it will be obvious to one skilled in the art that the invention may be practised with other types of corrugated substrates without departing from the scope thereof, for instance with a pleated substrate having sharp corners, whose top-view results in a star-type profile once rolled in a cylinder.

EXAMPLE

A 0.6 mm thick narrow-mesh net of 5 $m^2$ size was activated with a noble metal catalytic coating suitable for working in the concrete, and subsequently corrugated and cut in several 150 mm wide and 200 or 400 mm long pieces. The anodes so obtained have a current capacity of respectively 6.7 or 13 mA at a maximum current density of 110 $A/m^2$. Such current supply represents a higher value compared to prior art anodes for a given applied current density. A titanium rod was spot-welded in a central position as the current collector to each of the pieces obtained. The thus formed anodes were brought to a construction site wherein a cathodic protection system had to be installed for the ceiling and the columns of a bridge, particularly contaminated by chlorides in the water discharge zones from the overlaying road pavement. These zones required a particularly high current localised in the most contaminated portions (anodic zone).

250 mm deep and 65 or 130 mm wide holes, spaced by about 500 mm, were made in the concrete of the ceiling and of the columns, for easily installing the anodes of the invention in their interior, suitably rolled in cylinders by hand. To facilitate the installation in the pillar walls, plastic guide tubes were inserted in the holes obtained in the concrete, their diameter being slightly lower than that of the hole. The cylindrically-folded anodes were inserted inside the guide tube. At the time of positioning each anode, the guide tubes were removed. The anodes thus remained perfectly anchored to the wall of the hole allowing an easy filling of the latter by the operator. To install the anodes in the ceiling, they were formed in cylinders and the cylindrical shape was stabilised by using metal or plastic clips permitting a sufficient elastic allowance of the cylinder itself. Also in this case, once installed inside the holes of the ceiling to be protected, the cylindrical anodes were perfectly anchored to the internal surface of the holes themselves. In other areas of the bridge to be protected, more easily accessible, the anodes could be installed after being manually rolled in cylinders, with no need for guide tubes or for metal or plastic clips. After the installation, the anodes were suitably connected to a current rectifier by an appropriate wiring. Silver/silver chloride reference electrodes were also installed for monitoring the protection level.

The cathodic protection system was activated for a period of about 30 days after which the 100 mV depolarisation test, as universally prescribed by the norms for measuring the correct functioning of the system, was successfully performed. The previous description is not intended to limit the invention, which may be used according to different embodiments without departing from the scopes thereof, and whose extent is univocally defined by the appended claims.

Throughout the description and claims of the present application, the term "comprise" and variations thereof such as "comprising" and "comprises" are not intended to exclude the presence of other elements or additives.

The invention claimed is:

1. Cathodic protection system of reinforced concrete structure comprising: a metal reinforcement embedded in concrete, comprising a multiplicity of forcedly housed anodes, each of the anodes comprising a corrugated metal planar substrate welded to a current collector, the anodes being forcedly housed in a multiplicity of openings obtained in the concrete.

2. The cathodic protection system of claim 1, the metal planar substrate comprising a valve metal coated with a catalytic active layer.

3. The cathodic protection system of claim 2, the valve metal comprising pure titanium.

4. The cathodic protection system of claim 2, the catalytic active layer comprises noble metals and/or oxides thereof and/or oxides of other transition metals.

5. The cathodic protection system of claim 1, the metal planar substrate comprising one or more of meshes, solid sheets, perforated or expanded sheets, metal foams, and/or juxtapositions of meshes, sheets or foams.

6. The cathodic protection system of claim 5, the metal planar substrate comprising a mesh of initial thickness between 0.2 and 2 mm, and of final thickness after corrugation of 1 to 30 mm.

7. The cathodic protection system of claim 5, the corrugations of the metal planar substrate defined by a number of grooves comprised between 20 and 2000 per linear meter.

8. The cathodic protection system of claim 1, the current collector comprises a metal rod, bar or strap.

9. The cathodic protection system claim 1 prewelded in a cylindrical shape.

10. The cathodic protection system claim 1, further comprising an external ring or equivalent insulating means.

11. The cathodic protection system of claim 1, the anodes:

a) being rolled in open cylinders having the axis parallel to said current collector, forcedly housed in said multiplicity of holes obtained in the concrete; or b) being forcedly housed in a flat or bent open position in a multiplicity of slits drilled in the concrete.

12. The cathodic protection system of claim 11 wherein the anodes are embedded in the concrete inside the holes or the slits by application of a cement mortar.

13. Method for the installation of a cathodic protection system in a reinforced concrete structure comprising a metal reinforcement embedded in concrete, comprising:

obtaining a multiplicity of holes in the concrete;

forcedly housing inside each of said holes an anode comprising a corrugated metal planar substrate welded to a current collector and folded in a cylindrical position with axis parallel to a current collector; and fixing the anodes inside the holes with cement mortar applied by casting or by spraying.

14. The method of claim 13, the folded anodes being stabilised in the cylindrical position by metal or plastic clips.

15. The method of claim 13, pre-filling each of the anodes with a porous electrically insulating material prior to forcedly housing the anodes inside the holes.

16. Method for the installation of a cathodic protection system in a reinforced concrete structure comprising a metal reinforcement embedded in concrete, comprising:

obtaining a multiplicity of holes in the concrete;

forcedly housing inside each of said holes a stiff plastic guide tube;

inserting in each of said tubes an anode comprising a corrugated metal planar substrate welded to a current collector and folded in a cylindrical position with axis parallel to a current collector;

extracting said guide tubes leaving behind the anodes; and fixing the anodes inside the holes with cement mortar applied by casting or by spraying.

17. The method of claim 16, the folded anodes being stabilised in the cylindrical position by metal or plastic clips.

18. The method of claim 16, pre-filling each of the anodes with a porous electrically insulating material prior to forcedly housing the anodes inside the holes.

19. Method for the cathodic protection of a reinforced concrete structure comprising:

providing a cathodic protection system for the reinforced concrete structure comprising a metal reinforcement embedded in concrete, comprising a multiplicity of anodes, each of the anodes comprising a corrugated metal planar substrate welded to a current collector, the anodes being forcedly housed in a multiplicity of openings obtained in the concrete; and applying an anodic potential to the anodes of the cathodic protection system.

* * * * *